US009605533B2

(12) United States Patent
Eriksen et al.

(10) Patent No.: US 9,605,533 B2
(45) Date of Patent: Mar. 28, 2017

(54) LINER DRILLING BOTTOM HOLE ASSEMBLY LOCATOR SYSTEM AND METHOD

(71) Applicant: SCHLUMBERGER TECHNOLOGY CORPORATION, Sugar Land, TX (US)

(72) Inventors: Erik P. Eriksen, Calgary (CA); Michael Eric Moffitt, Kingwood, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 259 days.

(21) Appl. No.: 14/480,700

(22) Filed: Sep. 9, 2014

(65) Prior Publication Data

US 2015/0068805 A1 Mar. 12, 2015

Related U.S. Application Data

(60) Provisional application No. 61/875,532, filed on Sep. 9, 2013.

(51) Int. Cl.

| | |
|---|---|
| ***E21B 7/00*** | (2006.01) |
| ***E21B 47/09*** | (2012.01) |
| ***E21B 7/20*** | (2006.01) |

(52) U.S. Cl.
CPC ..... *E21B 47/09* (2013.01); *E21B 7/20* (2013.01)

(58) Field of Classification Search
USPC ..... 175/45, 162
See application file for complete search history.

(56) References Cited

U.S. PATENT DOCUMENTS

| | | | | |
|---|---|---|---|---|
| 2005/0029017 | A1 | 2/2005 | Berkheimer et al. | |
| 2006/0220651 | A1 | 10/2006 | Clark | |
| 2007/0107911 | A1 | 5/2007 | Miller et al. | |
| 2010/0096187 | A1 | 4/2010 | Storm et al. | |
| 2010/0282463 | A1 | 11/2010 | Boyle | |
| 2012/0325499 | A1* | 12/2012 | Moffitt | E21B 43/10 166/382 |

OTHER PUBLICATIONS

International Search Report and Written Opinion issued in PCT/US2014/054647 on Jan. 9, 2015, 13 pages.

* cited by examiner

*Primary Examiner* — Taras P Bemko

(57) ABSTRACT

A system and method for locating a bottom hole assembly during liner drilling. The system and method employ a liner and a drill string. The liner may include a stop sub. The drill string may include a bottom hole assembly position indicator. In one or more embodiments, the bottom hole assembly position indicator is configured to engage the stop sub and arrest further advancement of the drill string.

22 Claims, 1 Drawing Sheet

LINER DRILLING BOTTOM HOLE ASSEMBLY LOCATOR SYSTEM AND METHOD

CROSS-REFERENCE TO RELATED APPLICATION

This application claims the benefit of U.S. Provisional Application Ser. No. 61/875,532 filed Sep. 9, 2013, the entirety of which is incorporated by reference.

FIELD OF THE INVENTION

Aspects relate to drilling of wells in geological formations. More specifically, aspects relate to liner drilling bottom hole assembly locator system.

BACKGROUND

Oil and gas wells are conventionally drilled with drill pipe to a certain depth, then casing is run and cemented in the well. The operator may then drill the well to a greater depth with drill pipe and cement another string of casing. In this type of system, each string of casing extends to the surface wellhead assembly.

In some well completions, an operator may install a liner rather than another string of casing. The liner is made up of joints of pipe in the same manner as casing. Also, the liner is normally cemented into the well. However, the liner does not extend back to the wellhead assembly at the surface. Instead, it is secured by a liner hanger to the last string of casing just above the lower end portion of the casing. The operator may later install a tieback string of casing that extends from the wellhead downward into engagement with the liner hanger assembly.

When installing a liner, the operator drills the well to the desired depth, retrieves the drill string, then assembles and lowers the liner into the well. During assembly, a cement shoe with a check valve will normally be secured to the lower end portion of the liner as the liner is made up. When the desired length of liner is reached, the operator attaches a liner hanger to the upper end portion of the liner, and attaches a running tool to the liner hanger. A liner top packer may also be incorporated with the liner hanger. The operator then runs the liner into the wellbore on a string of drill pipe attached to the running tool. The operator sets the liner hanger and pumps cement through the drill pipe, down the liner and back up an annulus surrounding the liner (i.e., between the wellbore wall and the liner). The cement shoe prevents backflow of cement back into the liner. The operator then sets the liner top packer, if used, releases the running tool from the liner hanger and retrieves the drill pipe.

A variety of designs exist for liner hangers. Some may be set in response to mechanical movement or manipulation of the drill pipe, including rotation. Others may be set by dropping a ball or dart into the drill string, then applying fluid pressure to the interior of the string after the ball or dart lands on a seat in the running tool. The running tool may be attached to the liner hanger or body of the running tool by threads, shear elements, or by a hydraulically actuated arrangement.

In another method of installing a liner, the operator runs the liner while simultaneously drilling the wellbore. A drill bit is disposed at the lower end portion of the liner. This method is similar to a related technology known as casing drilling. One option is to not retrieve the drill bit, rather cement it in place with the liner. If the well is to be drilled deeper, the drill bit would have to be a drillable type. This technique is disfavored when components are desired to be retrieved from downhole. Such components may include one or more of downhole steering tools, measuring while drilling instruments and retrievable drill bits. Retrievable bottom hole assemblies are known for casing drilling, but in casing drilling, the upper end portion of the casing is at the rig floor. In typical liner drilling, the upper end portion of the liner is deep within the well and the liner is suspended on a string of drill pipe. In casing drilling, the bottom hole assembly can be retrieved and rerun by wireline, drill pipe, or by pumping the bottom hole assembly down and back up. With liner drilling, the drill pipe that suspends the liner is much smaller in diameter than the liner and has no room for a bottom hole assembly to be retrieved through it. If unable to retrieve and rerun the bottom hole assembly, the operator would not be able to liner drill with expensive directional steering tools, logging instruments and the like, without planning for removing the entire liner string to retrieve the tools.

Some liner drilling proposals instruct coupling a bottom hole assembly to a string of drill pipe and running the drill pipe to the bottom of the liner. Retrieving the drill string at the conclusion of the drilling would retrieve the bottom hole assembly.

Alternatively, if the operator wishes to retrieve the bottom hole assembly before cementing the liner, or if the operator wishes to rerun the bottom hole assembly and continue drilling with the liner, a process as disclosed in U.S. Patent Application Publication 20100282463 may be used. As disclosed therein, an operator may install a profile sub at a bottom portion of a liner string being made up and latch a bottom hole assembly to the profile sub. The bottom hole assembly includes the drill bit. The operator secures a liner hanger assembly to an upper portion of the liner string. Once the liner string is made up, the operator secures a lower end portion of a drill pipe string to an upper portion of the liner string and lowers the liner string on the drill pipe string until the drill bit reaches a bottom of the well. The drill bit may then be rotated to drill the well deeper. At a selected depth, the operator releases the bottom hole assembly from the profile sub and reverse circulates drilling fluid through a liner annulus surrounding the liner string. The reverse circulation pumps the bottom hole assembly up the liner string. When the bottom hole assembly reaches the lower end portion of the drill pipe string, the operator latches the bottom hole assembly to a catcher tool disposed at the lower end portion of the drill pipe string. The operator moves the liner hanger assembly into setting engagement with the casing string to support the weight of the liner string. Then the drill pipe string may be released from the liner string and retrieved along with the bottom hole assembly. If not at total depth, the operator may re-run the drill pipe string and the bottom hole assembly back into the casing string and re-securing the lower end portion of the drill pipe string to the upper portion of the liner string. The operator releases the liner hanger assembly from setting engagement with the casing string and releases the bottom hole assembly from the lower end of the drill pipe string. The operator pumps fluid down the drill pipe string to move the bottom hole assembly down the liner string latch into the profile sub. Drilling may then continue.

In casing drilling, the bottom hole assembly is spaced out at the shoe using a casing drilling drill lock assembly (DLA). The bottom hole assembly is relatively short, and spacing-out the under reamer arms with respect to the shoe ensures the system will drill new hole. This task is easily performed by measuring the short distance (approximately 20-30 feet) between the under reamer and the DLA, and the short distance (approximately 20 feet) from the casing shoe to the latching profile sub of the DLA. The difference in these distances indicates the location of the bottom hole assembly with respect to the shoe. These distances may be adjusted to facilitate the bottom hole assembly's ultimate location to ensure efficient drilling.

In contrast, during liner drilling, the bottom hole assembly is coupled to the liner near the top of the liner. The liner length varies depending on the job, and the liner top may be 1000 to 5000 feet or more away from the bottom hole assembly. To perform the under reamer space-out task per the steps discussed in casing drilling, the field engineer would need to have extremely accurate liner and drill pipe tallies, as there is little to no room for error in calculating this distance. Additionally, there is no secondary indication on the accuracy of the space-out. If the space-out is not done properly as the system is assembled on the rig floor (such as by mis-measurement or miscounted joints), the error can be undetected until after the liner is at the bottom of the hole, resulting in a mis-run. The potential cost on a deepwater project would be in the millions of dollars.

A method proposed to properly locate the bottom hole assembly includes use of a Hall-effect or magnetic-type sensor. The system pulses a signal to the surface once the bottom hole assembly is properly landed so that the floor personnel can continue to make-up the system and/or drill. Unfortunately, the space-out of this type of system needs to be accurate to within a few inches to ensure proper engagement of the reaming device or needs a thrusting sub to space-out the bottom hole assembly with respect to the liner shoe. In some instances, debris and other issues with the system have failed to produce a signal to surface, causing a mis-run with the system. Such a system is also somewhat complicated and expensive.

SUMMARY OF THE DISCLOSURE

In one aspect, embodiments disclosed herein relate to a system for locating a bottom hole assembly during liner drilling. The system may include a liner and a drill string. The liner may include a stop sub. The drill string may include a bottom hole assembly position indicator, the bottom hole assembly position indicator being configured to engage the stop sub and stop further advancement of the drill string.

In another aspect, embodiments disclosed herein relate to a method of installing a bottom hole assembly. The method may include installing a stop sub in a liner string a first distance above a liner shoe and running the liner string into a wellbore. A drill string having a bottom hole assembly may then be run inside the liner string. A bottom hole assembly position indicator is installed in the drill string a second distance relative to the bottom hole assembly, and the drill string is run into the wellbore until the bottom hole assembly position indicator engages the stop sub.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

According to one or more embodiments disclosed herein, a bottom hole assembly locator may be used to impart or verify the space-out distance of the liner drilling bottom hole assembly with respect to the liner shoe. The bottom hole assembly locator may be formed from two subs. The first sub—a stop sub—is installed and run into a hole (e.g., a borehole or wellbore) with the liner, and is generally disposed proximate (e.g., within a few hundred feet) the liner shoe. The stop sub is configured to allow bottom hole assembly components and tools to pass through a central bore thereof. The stop sub, however, will not allow the second sub—a bottom hole assembly locator sub—to pass. The second sub is installed and run into the hole with the drill string. The bottom hole assembly locator sub and stop sub may thus provide a purely mechanical means for locating the bottom hole assembly within the liner. In this manner, bottom hole assembly components may be located within the liner, as needed, and those components that need to be spaced out and located below the liner, may be properly located.

Systems and methods disclosed herein reduce the guesswork and mistakes associated with counting and measuring long lengths of pipe that would be needed for a system and method similar to that of casing drilling, as described above. By placing the bottom hole assembly locator sub a known distance relative to the bottom hole assembly and the stop sub a known distance from the liner shoe, space-out length and calculations to determine the locating of the under reamer with respect to the shoe are much easier to understand and calculate, with little or no chance of error. Embodiments disclosed herein also provide a positive second indication of desired bottom hole assembly placement to the calculated pipe tally.

Systems and methods disclosed herein also alleviate issues associated with Hall-effect and similar devices. One or more of the embodiments disclosed herein are both simple to run and entirely mechanical in construction. The field engineer does not need to rely on a signal pulsed to the surface from the bottom hole assembly to determine the bottom hole assembly is correctly located. Instead, a solid indication of space-out is received when the position indicator sub (i.e., bottom hole assembly locator sub) engages the stop sub, thereby arresting the drill string from advancing further into the hole.

Figure 1:
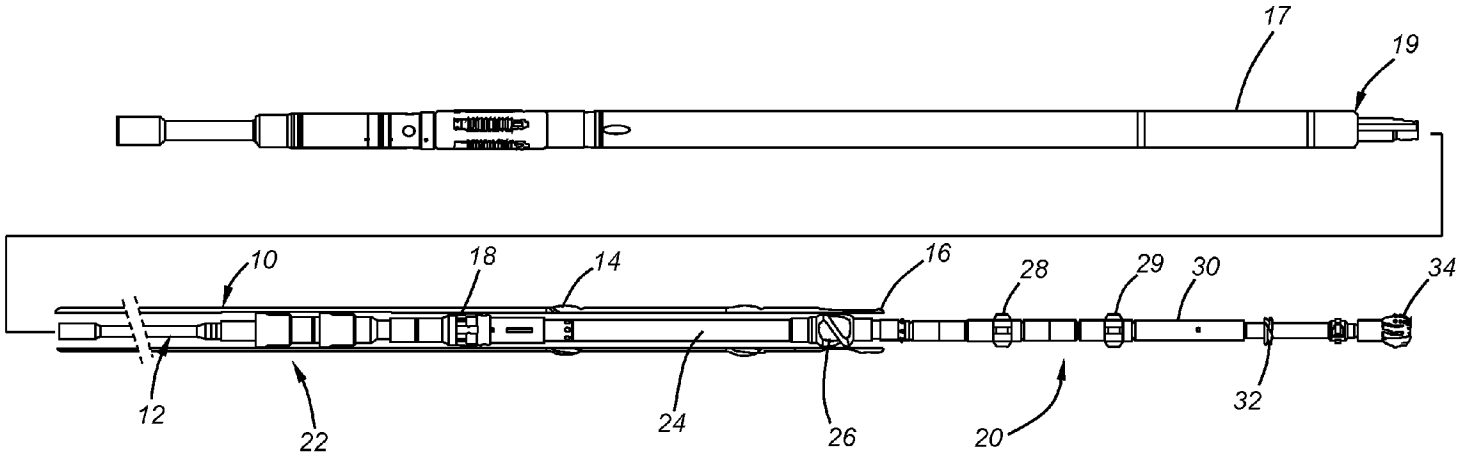
FIG. 1 illustrates a system for locating a bottom hole assembly during liner drilling according to one or more embodiments herein.
Figure 3:
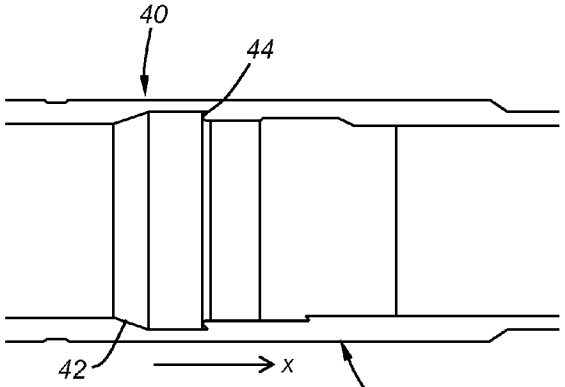
FIG. 3 illustrates a larger view of the stop sub as shown in FIG. 1.
Figure 2:
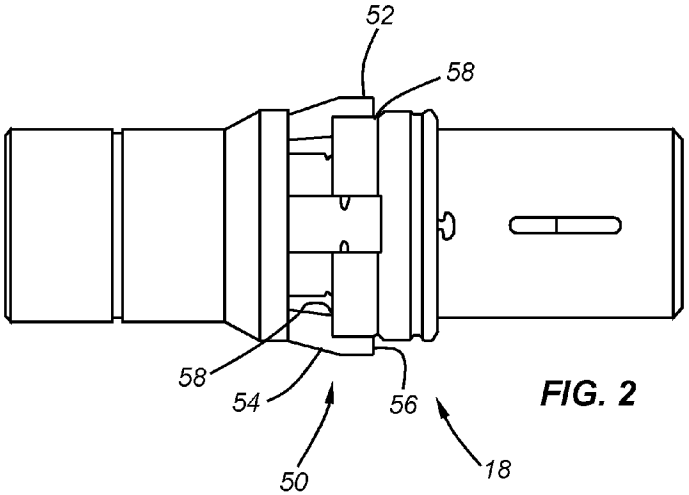
FIG. 2 illustrates a larger view of the bottom hole assembly position indicator as shown in FIG. 1.

Referring now to FIGS. 1-3, a system for locating a bottom hole assembly during liner drilling according to embodiments herein is illustrated. The system includes a liner 10 and a drill string 12. Liner 10 may include a stop sub 14 and a liner shoe 16. Liner 10 may also include a profile sub 17 configured to latch to the drill string 12, such as through a liner connection/innerstring connection 19. The drill string 12 may include a bottom hole assembly position indicator sub 18 and a bottom hole assembly 20. The bottom hole assembly position indicator 18 is configured to engage the stop sub 14 and stop further advancement of the drill string 12.

Bottom hole assembly 20 may be made up of various components. For example, for drilling operations, the bottom hole assembly 20 may include a sealing element 22, a drilling motor 24 (e.g., a mud motor), a drilling motor stabilizer 26, an under reamer 28, a back reamer 29, a logging while drilling (LWD) tool (not illustrated), a measurement while drilling (MWD) tool 30, a drill bit stabilizer 32, and a drill bit 34, among other components and tools commonly used during drilling. As illustrated in FIG. 1, the bottom hole assembly position indicator sub 18 is disposed in the drill string 12 between the sealing element 22 and the drilling motor 24. While the order of components may vary in different embodiments, in one or more embodiments it is desirable to have the sealing element 22 positioned uphole with respect to the position indicator 18, or sufficiently downhole, such that adjustments to bottom hole assembly location (in embodiments as described further below) do not result in the sealing element 22 being located proximate the stop sub 14, thereby possibly limiting the effectiveness of the sealing element 22. The bottom hole assembly position indicator 18 may also be positioned uphole of drilling motor 24 and drilling motor stabilizer 26. In one or more embodiments, it is desirable to locate the drilling motor stabilizer 26 proximate or within the liner shoe 16, such that the under reamer 28 and other components of the drill string and/or bottom hole assembly 20 are located an effective distance from the liner shoe 16. In such embodiments, the position indicator 18 should be uphole of the drilling motor stabilizer 26.

In some embodiments, the stop sub 14, as illustrated in FIG. 3, may include a circumferential groove 40. For example, circumferential groove 40 may include a taper, increasing in diameter with axial depth x, such as along slope 42, terminating at a radial shoulder 44. In some embodiments, the groove may also include a section of constant diameter intermediate the taper and the radial shoulder.

As illustrated in FIG. 2, the bottom hole assembly position indicator 18 may include a housing 50 that includes one or more spring-loaded dogs 52. In some embodiments, dogs 52 may have a profile shape corresponding to groove 40, including a sloped surface 54, terminating at a shoulder 56. As the bottom hole assembly 20 and drill string 12 is run into the liner 10, the dogs 52 are held collapsed (e.g., constrained within the liner 10) within pockets 58 inside the housing 50. At least a portion of the bottom hole assembly 20 is able to pass through the stop sub 14, however, the housing 50, upon reaching stop sub 14, cannot pass as the spring loaded dogs 52 open up, radially expanding to land inside groove 40 with shoulder 56 engaging shoulder 44. The downward movement of the bottom hole assembly is thus arrested, which gives a positive indication of the location of the bottom hole assembly with respect to the liner shoe 16 (FIG. 1). While arresting the downhole movement of the drill string, the position indicator 18 may be readily moved axially uphole from the stop sub 14 (uphole and downhole and other relative terms used herein are readily understood by those in the art to be with respect to the surface and the bottom of hole, irrespective of vertical, directional, or horizontal drilling). In some embodiments, the spring-loaded dogs 52 and drill string 12 are retractable without the need for additional force to be applied to disengage the bottom hole assembly position indicator 18 from the stop sub 14.

As noted above, the stop sub 14 may be positioned proximate, but uphole of, the liner shoe 16. For example, stop sub 14 may be positioned within the liner 10 within about 300 feet of the liner shoe 16, such as within 250 feet, 200 feet, 150 feet, 100 feet, 50 feet or less of the liner shoe 16. For proper locating of the bottom hole assembly 20, the bottom hole position indicator 18 is positioned a known distance relative to the bottom hole assembly 20 (e.g., a relative distance above or below certain bottom hole assembly components, such as 300 feet, 250 feet, 200 feet, 150 feet, 100 feet, or 50 feet, such that bottom hole assembly components to be retained/located within the liner 10 and bottom hole assembly components to be retained/located downhole of the liner 10 are appropriately and effectively located). For example, in some embodiments, the bottom hole assembly position indicator 18 may be positioned along the drill string 12 such that when the bottom hole assembly position indicator 18 engages the stop sub 14, the drilling motor stabilizer 26 is located within the liner shoe 16. In other embodiments, bottom hole assembly position indicator 18 may be positioned along the drill string 12 such that when the bottom hole assembly position indicator 18 engages the stop sub 14, the drilling motor stabilizer 26 is located beyond or downhole of the liner shoe 16 a selected distance. The length of the drill string 12 may be subsequently appropriately adjusted prior to drilling such that the drilling motor stabilizer 26 is located within the liner shoe 16.

The systems as disclosed above may be used in methods for installing a liner and a drill string along with proper locating of the bottom hole assembly. For example, according to one or more embodiments disclosed herein, a method of installing a bottom hole assembly 20 may include a first step of installing a stop sub 14 in a liner string 10 a first distance above a liner shoe 16. The liner string 10 may then be run into the wellbore. After liner installation, a bottom hole assembly 20 and an associated drill string 12 may be run through and appropriately coupled to the liner 10, such as through a liner connection/inner string (drill string) connection 19 proximate a liner profile sub/nipple 17. For running the bottom hole assembly 20 and drill string 12 downhole, a bottom hole assembly position indicator 18 may be installed in the drill string 12 a second distance relative to the bottom hole assembly 20 (e.g., a second distance relative to the various bottom hole assembly components). The drill string 12 may then be run into the wellbore until the bottom hole assembly position indicator 18 engages the stop sub 14.

In some embodiments, the first distance and second distance may be selected such that when bottom hole assembly position indicator 18 engages the stop sub 14, the drilling motor stabilizer 26 is located within the liner shoe 16. In such an embodiment, drilling occurs with the bottom hole assembly position indicator 18 engaged with the stop sub 14. Both the stop sub 14 and the position indicator 18 may rotate, if at all, at similar speeds or the same speed, and/or be configured of appropriate materials, thus avoiding wear or frictional welding of the components.

Alternatively, the drill string 12 may be withdrawn, and the bottom hole assembly indicator sub 18 may be removed from the drill string 12 and replaced with a blank sub or pup joints of the same length. In this manner, the total length of the drill string remains constant, or approximately constant, thereby resulting in the drilling motor stabilizer 26 being properly located within the liner shoe 16 even after withdrawal. Drilling may thus be conducted without the position indicator 18 engaged with the stop sub 14.

In other embodiments, it may be desirable to drill with the bottom hole assembly position indicator 18 still positioned in the drill string 12 but not engaged with the stop sub 14. For example, when drilling offshore, it may be desirable to have some distance between the position indicator 18 and the stop sub 14, thereby allowing for heave or other movements of the drill string 12 in both directions relative to the liner 10 without fear of the hard stop hindering movement of the drill string 12. In such embodiments, the bottom hole assembly position indicator 18 may be positioned (during installation) along the drill string 12, via proper selection of the first distance and second distance, such that when the bottom hole assembly position indicator 18 engages the stop sub 14, the drilling motor stabilizer 26 is located beyond (or downhole of) the liner shoe 16 a selected distance, such as a distance in the range from about 1 foot to about 10 feet or more, such as 2 feet to 3 feet. The length of the drill string 12 may be subsequently appropriately adjusted prior to drilling such that the drilling motor stabilizer 26 is located within the liner shoe 16. For example, an operator may tally the drill pipe while the drill string 12 is being run. When the position indicator 18 lands in the stop sub 14, the tally may be noted, drill pipe may be appropriately marked, and the last drill pipe joint may be removed. The distance from the mark to the top of the next joint (the portion of the drill string below the last joint) may then be measured. In place of the last joint, a pup joint, multiple pup joints or drill string segment of a predetermined shorter length than the measured distance may then be installed, the predetermined length being sufficient to result in the drilling motor stabilizer 26 being within the liner shoe 16. For example, when the drilling motor stabilizer 26 is located about 2 feet beyond the liner shoe 16, the difference in the measured distance between the mark and the top of the next joint may be reduced by about 3 to 4 feet to ensure locating of the drilling motor stabilizer 16 within the liner shoe 16 while providing some distance for heave and other movement of the drill string 12.

As another example, the bottom hole assembly position indicator 18 may include the spring loaded dogs 52, as described above. However, instead of positioning the position indicator sub 18 uphole with the dogs 52 retracted (constrained by the liner 16) after tagging (or engaging) the stop sub 14, the position indicator sub 18 may be designed to allow the dogs 52 to shoulder out in the stop sub 14. Components of position indicator sub 18 designed to shear at a predetermined load, could be sheared, allowing the dogs 52 (or landing device) to retract. In this manner, the position indicator sub 18 may be allowed to pass through the stop sub 14. Similar calculations as noted above may then be used to adjust drill string pup joints or segments a desired length so as to locate the position indicator 18 below (or downhole of) the stop sub 14 and the drilling motor stabilizer 26 in the desired location. Thus, as disclosed herein, the final location of the bottom hole assembly position indicator 18 during drilling may be above or below the stop sub 14 once the bottom hole assembly 20 is in its final location after space-out.

During the drilling operations, one or more components of the bottom hole assembly 20 may need servicing or replacement. For example, a drill bit 34, reamer 28, 29, or other cutting structures may need to be replaced. When the bottom hole assembly 20 is withdrawn to perform the servicing or replacement, the bottom hole assembly indicator sub 18 may be removed from the drill string 12 and replaced with a blank sub or pup joints of the same length. In this manner, the total length of the drill string 12 remains constant or approximately constant, resulting in the drilling motor stabilizer 26 being properly located within the liner shoe 16, even after withdrawal and re-running. The replacement of the position indicator 18 with an equivalent length of pup joints may also facilitate re-running of the drill string 12, as the position indicator sub 18 may not be able to pass downward through the top of the liner 10 (i.e., the position indicator 18 may be used once to properly locate the bottom hole assembly 20; subsequent runs and proper locating are then facilitated by the known distances, equivalently replaced sections, and tallies, thus minimizing errors, even during re-runs and servicing; this maintains a consistent distance for the drill string 12 between the connection 19 of liner profile nipple 17 and the liner shoe 16).

Tools of the drill string 12, between the motor stabilizer 26 and the drill bit 34, should also be properly positioned. The uppermost such tool may be disposed a sufficient distance below the motor stabilizer 26 such that the uppermost tool is not located within the liner 10 or the liner shoe 16. For example, it may be desirable to maintain a distance of 10 to 12 feet between the drilling motor stabilizer 26 and under reamer 28. The initial installation of the components in the drill string 12 may account for the desired distance, and adjustment of drill string lengths as noted above should be carefully made such that the drilling motor stabilizer 26 is located within the liner shoe 16, and the under reamer 28 are located the desired distance downhole of the liner 10.

One or more embodiments disclosed above relate to the proper locating of a drilling motor stabilizer 26 within a liner 10. In other embodiments, the bottom hole assembly position indicator 18 may similarly be used to locate other drill string components, such as a drive sub or other drill string components, proximate a desired location within the liner 10 (or liner shoe 16), or proximate a desired distance below the liner shoe 16. Proximate, as used herein, refers to being located within a distance range from the desired location, such as +/−2 to 3 feet in some embodiments, or +/−0.5 to 1 feet in other embodiments.

As disclosed above, one or more embodiments herein provide systems and methods for properly locating a bottom hole assembly 20 with respect to a liner 10 or a liner shoe 16. The bottom hole assembly locator sub 18 and stop sub 16 disclosed herein may provide a purely mechanical means for locating the bottom hole assembly 20 within the liner 10. By use of a purely mechanical means for locating the bottom hole assembly 20, errors associated with sensor equipment as well as human errors associated with counting 1000 to 5000 feet or more of drill string and liner segments may be avoided. Due to the reduction in errors, mis-runs may be reduced, thereby reducing the number of re-runs and increasing drilling time, resulting in savings during drilling operations.

While the disclosure includes a limited number of embodiments, those skilled in the art having benefit of this disclosure, will appreciate that other embodiments may be devised which do not depart from the scope of the present disclosure. Accordingly, all such modifications are intended to be included within the scope of this disclosure.

What is claimed is:

1. A system for locating a bottom hole assembly during liner drilling, comprising:

a liner having a stop sub proximate a liner shoe; and a drill string having a bottom hole assembly position indicator uphole of a drilling motor and drilling motor stabilizer, the bottom hole assembly position indicator configured to engage the stop sub and arrest further advancement of the drill string and disposed in the drill string such that when the bottom hole assembly position indicator engages the stop sub, the drilling motor stabilizer is located within the liner shoe or is located a selected distance downhole of the liner shoe.

2. The system of claim 1, wherein the stop sub includes a circumferential groove; and the bottom hole assembly position indicator includes at least one spring-loaded dog configured to radially expand and engage the circumferential groove in the stop sub and arrest further advancement of the drill string within the liner.

3. The system of claim 2, wherein the circumferential groove comprises a taper increasing in diameter with axial depth and terminating at a radial shoulder.

4. The system of claim 3, wherein the groove further comprises a section of constant diameter between the taper and the radial shoulder.

5. The system of claim 3, wherein the at least one spring-loaded dog and the drill string are retractable without additional force being applied to disengage the bottom hole assembly position indicator from the stop sub.

6. The system of claim 1, the drill string further comprising a sealing element configured such that the bottom hole assembly position indicator is disposed in the drill string between the sealing element and a drilling motor.

7. The system of claim 1, wherein the stop sub is uphole of the liner shoe.

8. The system of claim 7, wherein the stop sub is within about 300 feet of the liner shoe.

9. The system of claim 7, wherein the bottom hole assembly position indicator is disposed in the drill string such that when the bottom hole assembly position indicator engages the stop sub, a drill string component is located within one of the liner and liner shoe at a desired location or at a selected distance from a desired location.

10. The system of claim 1, wherein when the bottom hole assembly position indicator engages the stop sub, the drilling motor stabilizer is located between about 1 foot and about 10 feet downhole of the liner shoe.

11. The system of claim 1, wherein when the bottom hole assembly position indicator engages the stop sub, the drilling motor stabilizer is located between about 2 feet and about 3 feet downhole of the liner shoe.

12. A method of installing a bottom hole assembly, comprising:

installing a stop sub in a liner string a first distance above a liner shoe;

running the liner string into a wellbore;

inside the liner string, running a bottom hole assembly on a drill string;

installing a bottom hole assembly position indicator in the drill string a second distance relative to the bottom hole assembly; and running the drill string into the wellbore until the bottom hole assembly position indicator engages the stop sub.

13. The method of claim 12, wherein the first distance and second distance are selected to one of locate and facilitate locating of a drill string component within the liner or the liner shoe at a desired location.

14. The method of claim 12, further comprising drilling the wellbore.

15. The method of claim 14, wherein the bottom hole assembly position indicator is engaged with the stop sub during the drilling.

16. The method of claim 15, wherein the first distance and second distance are selected to locate a drill string component within the liner shoe when the position indicator engages the stop sub.

17. The method of claim 14, wherein the bottom hole assembly position indicator is not engaged with the stop sub during the drilling.

18. The method of claim 17, wherein the first distance and second distance are selected to locate a drill string component a selected distance with respect to a desired location within the liner or the liner shoe when the position indicator engages the stop sub.

19. The method of claim 18, further comprising replacing a section of drill pipe, the bottom hole assembly position indicator, or both, with a sub or joint that is either longer or shorter in length such that the drill string component is located proximate the desired location within the liner or the liner shoe.

20. The method of claim 14, further comprising:

withdrawing the bottom hole assembly from the wellbore;

replacing or servicing at least one component of the bottom hole assembly; and re-running the bottom hole assembly and drill string into the wellbore.

21. The method of claim 12, wherein the drill string further comprises at least one tool disposed between a drilling motor stabilizer and a drill bit, the method further comprising disposing the at least one tool a sufficient distance below the drilling motor stabilizer such that, after the drilling motor stabilizer is located within the liner or liner shoe using the bottom hole position indicator, the at least one tool is not located within the liner or the liner shoe.

22. The method of claim 21, wherein the at least one tool comprises at least one of an under reamer, a back reamer, a drill bit stabilizer, a logging while drilling tool, and a measurement while drilling tool.

* * * * *